US006386988B1

(12) United States Patent
Shearer et al.

(10) Patent No.: US 6,386,988 B1
(45) Date of Patent: May 14, 2002

(54) GOLF SWING TRAINING AND EXERCISE DEVICE

(75) Inventors: Randy Shearer, Missouri City; John Begnaud, Kingwood; Ira Kisver, The Woodland, all of TX (US)

(73) Assignee: SBK Innovations, L.P., Missouri City, TX (US)

( * ) Notice: Subject to any disclaimer, the term of this patent is extended or adjusted under 35 U.S.C. 154(b) by 0 days.

(21) Appl. No.: 09/597,063

(22) Filed: Jun. 20, 2000

(51) Int. Cl.[7] ..... A63B 21/00; A63B 57/00

(52) U.S. Cl. ..... 473/220; 473/257; 473/267; 473/274; 473/278

(58) Field of Search ..... 473/207–209, 473/212, 219–225, 257, 266–267, 274, 276, 278; 482/34, 106, 107; 372/4, 5, 81

(56) References Cited

U.S. PATENT DOCUMENTS 4,043,553 A * 8/1977 Suarez
4,440,391 A * 4/1984 Saenz
4,623,146 A * 11/1986 Jackson
5,221,244 A * 6/1993 Doss
5,269,528 A * 12/1993 McCardle
5,399,135 A * 3/1995 Azzouni
5,954,592 A * 9/1999 Laffer
5,993,333 A * 11/1999 Heckaman
6,013,013 A * 1/2000 Wolf
6,059,668 A 5/2000 Marley, Jr. ..... 473/218
6,196,921 B1 * 3/2001 Larson
6,217,495 B1 * 4/2001 Yalch
6,254,493 B1 * 7/2001 Wurster
6,280,364 B1 * 8/2001 Deac

OTHER PUBLICATIONS

LaserEyes: Dual Laser Swing Analyzer LazerEyes Burbank, CA ® 1997–2000, From: www.Lazereyes.com.

* cited by examiner

*Primary Examiner*—Stephen Blau
(74) *Attorney, Agent, or Firm*—Philip S. Lyren

(57) ABSTRACT

A golf swing training and exercise system for improving the golf swing of a golfer. The system includes a mat with an optically reflective surface, an elongated golf device having three sections and two lasers. Each laser attaches to one end of the golf device and projects a laser beam onto a mat.

19 Claims, 2 Drawing Sheets

GOLF SWING TRAINING AND EXERCISE DEVICE

FIELD OF THE INVENTION

The present invention generally relates to a golf swing training system and device for improving the golf swing of a user. In addition to providing golf training, the system and device also serve to strengthen and condition the muscles of the user, increase flexibility and torque, and enhance the power of the golf swing.

BACKGROUND OF THE INVENTION

The game of golf is not an exact science, and in order to play the game well, a golfer needs a high level of athleticism, accuracy, and consistency. In fact, many golfers believe that consistency is one of the most important factors for playing the game well. A golfer with a consistent golf swing is able to strike the golf ball in a more predictable manner, thus giving the golfer more control over the aim and direction of each golf shot.

In an attempt to assist golfers in attaining a higher level of consistency, many golf training and exercise devices exist. Most of these devices are oriented toward one of two goals: either providing the golfer with a training device to improve his swing mechanics or providing the golfer with an exercise device to strengthen his swing.

U.S. Pat. No. 6,059,668 shows an example of a device designed to improve a golfer's swing. The device consists of a training light that attaches to the shaft of a golf club. The training light projects a beam that runs parallel to the shaft of the club and onto the ground in front of the golfer. As the golf club is swung, the beam traces the path of the club along the ground. The golfer can thus follow the reflection of the beam and visually trace the path of the golf club.

Various exercises and exercise devices oriented toward golf exist as well. Golfers often use specific exercises to strengthen and condition their muscles or to stretch and loosen them before playing. In some instances, golfers will place a club behind their neck, grasp the ends of the club, and twist back and forth to simulate the motion of a golf swing. This exercise is often performed during a warm-up or practice period before play begins.

One disadvantage with current golf swing devices is that the devices are generally designed to function as either a training device or an exercise device. A device that performs both functions would have the advantages of both devices.

SUMMARY OF THE INVENTION

The present invention is directed toward a golf training system that performs dual and simultaneous functions of training and exercising the user. The system generally consists of a golf device having an elongated bent shape and a mat having an optically reflective top surface. The golf device consists of a middle section with two arms extending outwardly from the ends of the middle section. The arms form an angle with respect to the middle section and have an equivalent length. A pad is positioned around the exterior surface of the middle section to provide a soft cushion for the user. Each arm includes a laser connected to and projecting from a distal end of the arm. The arms also include a handgrip that is shaped to accommodate a hand of a user.

In order to use the golf training system, the golfer stands in front of the mat and places the golf device on his shoulders and his hands on the handgrips. The golf device is then positioned such that the laser beams are directed onto the mat in front of the golfer. Typically, the golfer will assume a golfing stance and then rotate back and forth to simulate and practice the motion of a full golf swing. As the golfer rotates through the golf swing, the laser beams reflect off the mat and provide visual guidance and feedback to the golfer.

One important advantage of the present invention is that it simultaneously functions as both a golf training device and a golf exercise device. In this regard, the golf device is weighted so the user strengthens and conditions his muscles during use. At the same time, the user develops and enhances "muscle memory" of a smooth, complete shoulder turn in his golf swing. Additionally, the lasers are used in conjunction with a graphical display on the reflective mat to aid the user in developing a proper golf swing. Together, the training and exercise functions of the golf training system help the user to develop a smooth shoulder turn and ultimately a more powerful and consistent golf swing.

DETAILED DESCRIPTION

Figure 1:
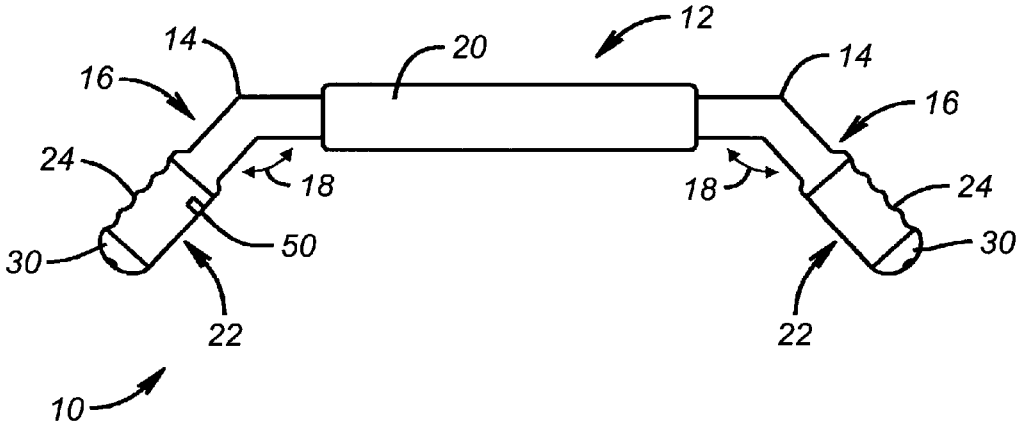
FIG. 1 is a side-view of the golf swing training and exercise device according to the invention.
Figure 2:
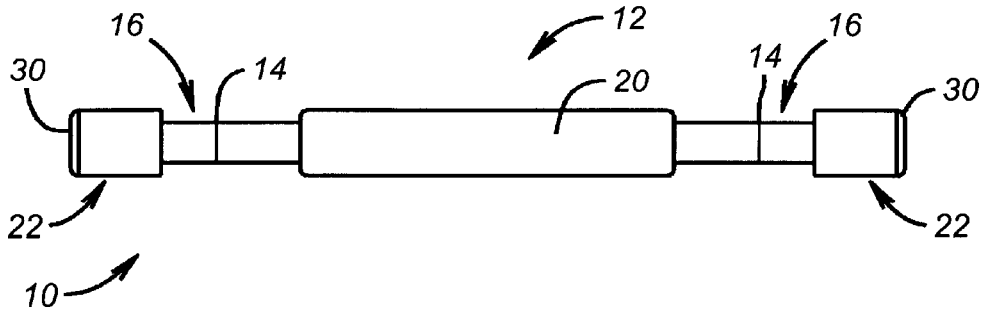
FIG. 2 is a top-view of the golf swing training and exercise device of FIG. 1.

FIGS. 1 and 2 show a golf swing training and exercise device 10 of the present invention. The golf device has three elongated cylindrical sections: a main or middle section and two arm sections. The middle section 12 extends horizontally to two junctions or transition locations 14. The arms 16 extend outwardly from each of these junctions.

In the preferred embodiment, the main section 12 has a length of about 24" to 36", and each arm has a length of about 5" to 12". In addition, as shown in FIG. 1, the arms extend at an angle 18 to the main section. This angle can vary between about 20 to 60 degrees, but preferably is about 45 degrees.

The main section includes a pad 20 that extends around a portion of the device. The pad is preferably made of foam, rubber, or suitable soft and protective material that provides a resilient cushion around the main section. The pad thus acts as a cushion to make the golf device comfortable and easy to use.

Each arm 16 includes a handgrip 22 disposed at a distal end. Preferably, these grips are shaped to accommodate the hand of a golfer during use of the golf device. As such, the top of each grip includes indentations or marks 24 spaced and sized to receive a hand. The grips provide secure hand support for the user and help ensure correct hand position while the golf device is being used. The grips may be formed from rubber, polymer, or other material known to those skilled in the art.

Figure 3:
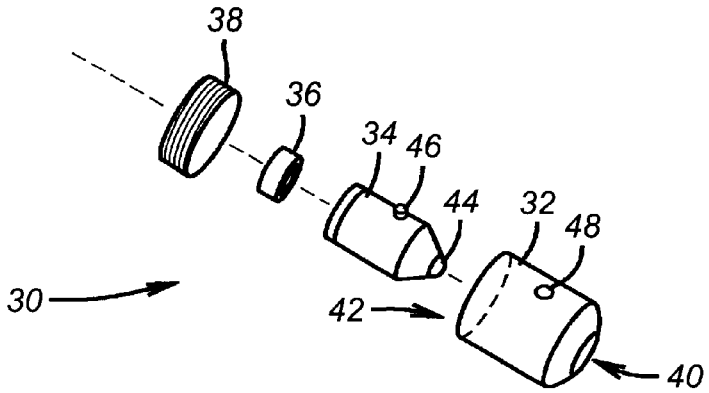
FIG. 3 is an exploded perspective view of a laser used in conjunction with the golf swing training and exercise device.

Each arm 16 also includes a light beam source or laser 30 located at the distal end. FIG. 3 shows the laser in more detail. As shown, the laser 30 comprises four components: a housing 32, a light source 34, a battery 36, and an end cap 38.

The housing 32 has a cylindrical configuration with a narrow, open front end 40 and a threaded back end 42. A cavity extends inside the housing to receive the light source and battery.

The light source 34 may be one of various devices known in the art, such as a laser diode. As shown, this device fits into the interior cavity of the housing until a tip portion 44 protrudes through the open front end 40. A conventional on/off switch 46 is located on the outer surface of the light source and is adapted to fit through an opening 48 located in the housing 32. The battery 36 contacts the end of the light source to provide energy to the laser.

As shown, the end cap 38 has a threaded exterior to engage the internal, threaded back end 42 of the housing 32. The end cap secures the battery and light source inside the housing and provides easy access to the internal components when the battery or light source needs serviced or replaced.

Looking to FIGS. 1–3, the laser can connect to the end of each arm 16 in a variety of different ways known to those skilled in the art. For example, the end of each arm can have an open, hollow shape. This opening can be sized to receive the housing 32 of the laser. The housing can be friction fit inside the opening, screwed into the opening, or retained in the opening with a screw (not shown) extending through the arm to engage the housing.

As shown in FIG. 1, the handgrip 22 may include a switch 50 connected to the on/off switch 46 (FIG. 3) of the light source. This switch enables the user of the golf device 10 to activate the laser. The switch may be, for example, a pressure-activated switch or other type of switch known to those skilled in the art. Activation of the laser may be accomplished in other ways as well, without departing from the scope of this invention.

Once the laser is activated, it will direct an intense beam of light from the end of the arm 16. The direction of this light beam may be preset to shine in a given direction toward the ground, or the direction may be set to vary. In the latter instance, the light source 34 may be adjustable to shine in various directions.

Preferably, the main section 12 and arms 16 of the golf device are fabricated from a metallic material, such as cold rolled steel or stainless steel, or from a strong and durable polymer. These sections may be formed as a single piece or as multiple sections, such as three separate pieces. These separate pieces could be threadably connected together to form the golf device. Furthermore, the golf device may be formed as a solid bar or as a hollow member, such as a tube. Additionally, the shaft preferably has a diameter between about 1" and 1¼", and the pad has a thickness of about ¼" to ½".

Figure 4:
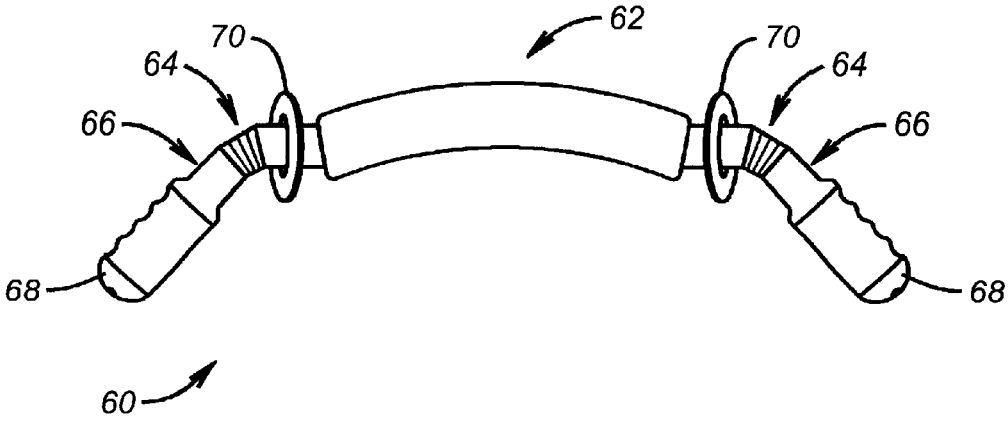
FIG. 4 is an alternate embodiment of the golf swing training and exercise device.

FIG. 4 shows an alternate golf swing training and exercise device 60. This golf device 60 has three main differences to the golf device 10 shown and described in connection with FIG. 1.

First, the main section 62 is anatomically shaped to have a bowed configuration. This bow smoothly and easily curls around the neck of the user during use and provides a comfortable contact zone.

Second, the junction 64 between the arms 66 and the main section 62 enables the arms to move or rotate relative to the main section. In this embodiment, the arms can be positioned to have various angles with respect to the main section. The user is thus able to adjust the angle and position of the arms to change the direction and orientation of the lasers 68. Furthermore, movement of the arms enables the user to customize the geometric shape of the golf device. Such movement would be particularly advantageous for multiple users having different heights and body shapes.

The junction between the arms and main section may be formed in various ways known to those skilled in the art. For instance, the junction may be formed as a hinge connection, a pivotal connection, a sliding connection, or a ball and socket connection. Preferably, the junction enables the arms to rotate 360 degrees about the main section.

Third, one important advantage of the present invention is that the golf device functions to strengthen and condition the muscles of the user. In order to perform this function, the golf device should have a weight between about ten to thirty pounds. As shown in FIG. 4, weights 70 may be removably added to the golf device to change its overall weight. The user can thus easily and quickly change the weight of the golf device. In this figure, two weights are shown; however, multiple weights can be added. The weights should be available in one to five pound increments. Preferably, the maximum weight of the golf device itself is about seven to fifteen pounds, and the overall weight of the golf device plus the weights does not exceed about 30 pounds. The main section 62 may include grooves, markings, or other indicia (not shown) to indicate the location for the weights.

Since the golf device performs an exercise function, it can be used to warm-up and loosen the muscles of a golfer before play or practice begins. The golfer can thus lessen the chance of injury by warming up.

Figure 5:
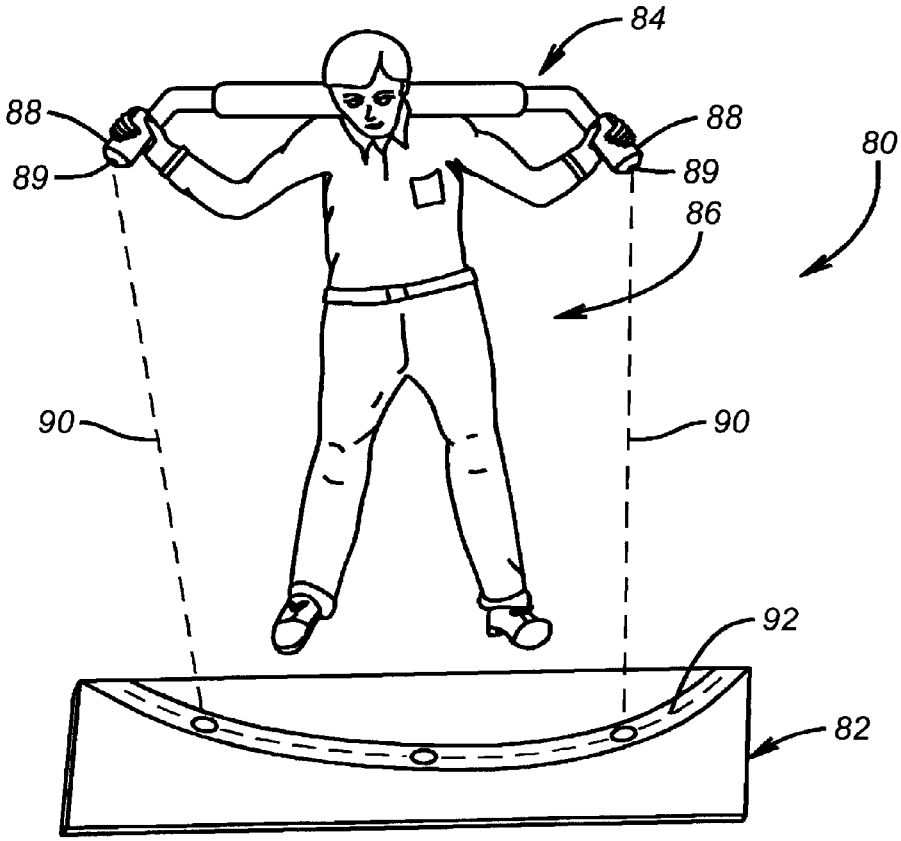
FIG. 5 is a frontal perspective view of the golf training system and shows a golfer utilizing the golf swing training device in conjunction with a light reflective mat.

Turning now to FIG. 5, a golf training system is shown at 80. The system generally includes a reflective mat 82 and a golf device 84 as described in connection with FIGS. 1–4. As shown in the figure, a golfer or user 86 stands in front of the mat and places the golf device on his shoulders with his hands on the handgrips 88. The lasers 89 are activated to direct the laser beams 90 onto the mat in front of the golfer. Typically, the golfer will assume a golfing stance and then rotate to simulate the motion of a full golf swing. As the golfer rotates through the golf swing, the laser beams will reflect off the mat and provide visual guidance to the golfer.

One important advantage of this system is that the golf device may be used as a training device to aid and improve the swing of a golfer. In this regard, the golf device and mat orient the golfer to the proper motion needed to swing a golf club accurately and effectively. As shown in the FIG. 5, the mat 82 is provided with indicia 92 (such as a graphical display) that illustrate the proper path for a golf club. While the golfer rotates through his swing, the laser beams will illuminate along the graphical display to indicate whether a proper swing path is being followed. If the laser beams illuminate inside and along the graphical display, then the proper swing path is being followed. If, however, the beams are outside the graphical display, then the proper swing path is not being followed.

Preferably, the mat is formed from lightweight and durable materials that have an optically reflective top surface and a frictional back surface (such as rubber). The reflective top surface may, for example, be formed from a polymer and shaped as a prism or formed from a reflective fabric. Furthermore, the shape of the mat may vary but should be about three feet in length and two feet in width.

The invention claimed is:

1. A golf swing training and exercise system, comprising:

a mat having an optically reflective top surface;

a golf device having three separate sections, including an elongated middle section and two arm sections, wherein each arm section has a distal end and a proximal end connected to the middle section, the arms sections extends outwardly at an angle with respect to the middle section, the golf device being adapted to be placed on shoulders of a golfer and gripped with hands at the distal ends of the arm sections; and two lasers, wherein each laser connects to a distal end of an arm section, the lasers being adapted to project a laser beam on the reflective top surface of the mat.

2. The golf swing training and exercise system of claim 1 further including two handgrips, wherein each handgrip is adjacent a laser and connected to an arm section at the distal end, the handgrips being adapted to receive a hand of the golfer.

3. The golf swing training and exercise system of claim 2 in which the lasers include a pressure activated on/off switch that is mounted on the handgrips.

4. The golf swing training and exercise system of claim 1 in which the proximal end of each arm section forms an angle of between about 30 to 50 degrees with the middle section.

5. The golf swing training and exercise system of claim 4 in which the angle each arm section forms with the middle section is the same, and the middle section and arm sections have an elongated cylindrical configuration.

6. The golf swing training and exercise system of claim 5 in which the arm sections each have a length of about 5" to 12", and the middle section has a length of about 24" to 36".

7. The golf swing training and exercise system of claim 4 in which the golf device weighs between seven and fifteen pounds.

8. The golf swing training and exercise system of claim 7 further comprising at least two weights, the weights being adapted to be removably attached to the middle section or arm sections of the golf device.

9. The golf swing training and exercise system of claim 8 in which the golf device and weights combine to have a weight not greater than about thirty pounds.

10. A golf device for training and exercising a golfer, the golf device comprising:

a middle section having an elongated shape with two ends;

two arms, each arm having a distal end and a proximal end;

two junctions, each junction connecting a proximal end of an arm to one end of the middle section, wherein each arm extends outwardly from the middle section and forms an angle with the middle section; and two lasers, each laser being connected to a distal end of the arm, the lasers being adapted to emit a laser beam from the distal end of the arm, and the golf device being adapted to be placed behind a neck and on shoulders of the golfer during use.

11. The golf device of claim 10 in which the arms are moveable in order to change the angle between the arms and the middle section.

12. The golf device of claim 10 in which the middle section is anatomically shaped to have a bowed configuration.

13. The golf device of claim 10 further including a soft, resilient pad that extends around the middle section, the pad being adapted to contact the neck and shoulders of the golfer.

14. The golf device of claim 10 in which the middle section and arms have a combined weight of about seven to fifteen pounds.

15. The golf device of claim 10 further including at least two weights removably attachable to the middle section or arms; and two handgrips, wherein each handgrip connects to an arm adjacent the distal end.

16. A system for training and exercising golfers, the system comprising:

a mat having a top surface adapted to reflect a laser beam;

a golf device having an elongated, bent shape and including: two arms and a middle section connected to and extending between the arms, wherein each arm forms an angle with respect to the middle section;

two handgrips, wherein each handgrip is connected to one arm; and two lasers, wherein each laser connects to a distal end of an arm, the lasers being adapted to project a laser beam on the top surface of the mat while a golfer places the golf device behind his neck and on his shoulders.

17. The system of claim 16 in which the middle section has a length of about 24" to 36" and a diameter between about 1" and 1¼"; and each arm has a length of about 5" to 12".

18. The system of claim 16 in which the arms are rotatably mounted to the middle section.

19. The system of claim 18 in which the lasers are rotatably mounted to the arms.

* * * * *